US005328885A

United States Patent [19]

Chosa et al.

[11] Patent Number: 5,328,885

[45] Date of Patent: Jul. 12, 1994

[54] TRANSFER RECORDING MEDIUM

[75] Inventors: Yosei Chosa; Masato Yoshida, both of Tokyo; Takayuki Yokoyama, Yokohama; Hirokatsu Shimada, Machida, all of Japan

[73] Assignees: Toppan Printing Co., Ltd., Tokyo; Minolta Camera Kabushiki Kaisha, Osaka, both of Japan

[21] Appl. No.: 968,527

[22] Filed: Oct. 29, 1992

[30] Foreign Application Priority Data

Oct. 31, 1991 [JP] Japan ..... 3-285297

[51] Int. Cl.[5] ..... B41M 5/035; B41M 5/38

[52] U.S. Cl. ..... 503/227; 428/195; 428/412; 428/413; 428/447; 428/474.4; 428/484; 428/500; 428/913; 428/914

[58] Field of Search ..... 8/471; 428/195, 212, 428/913, 914, 412, 413, 447, 474.4, 484, 500; 503/227

[56] References Cited

FOREIGN PATENT DOCUMENTS 2-175291 7/1990 Japan .
2-175292 7/1990 Japan .

*Primary Examiner*—B. Hamilton Hess
*Attorney, Agent, or Firm*—Armstrong, Westerman, Hattori, McLeland & Naughton

[57] ABSTRACT

A transfer recording medium capable of obtaining a satisfactory transfer image is provided without fusing a base film due to heat even if the medium is used for a printer using a large-output laser beam. The medium is made by forming an adiabatic layer or a heat absorbing layer between the base film and a light-heat conversion layer or an ink layer containing a light-heat conversion agent and sublimating dye formed on one side of the base film or forming the heat absorbing layer on the other side of the base film.

9 Claims, 2 Drawing Sheets

TRANSFER RECORDING MEDIUM

BACKGROUND OF THE INVENTION

1. Field of the Invention

The present invention relates to the constitution of a transfer recording medium used for sublimating-type transfer recording using a laser beam.

2. Background Art

As disclosed in the official gazettes of Japanese Patent Laid-open Publication Nos. 2-175291 and 2-175292, the existing transfer recording medium used for sublimating-type transfer recording using a laser beam has a constitution in which a light-heat conversion layer absorbing far infrared and producing heat and a dye layer where a sublimating dye is held on a binder resin are laminated in order on a film made of PET (polyethylene terephthalate) with the thickness of 2 to 8 μm or the like.

However, though the transfer recording medium with the above constitution can be used for a printer using a relatively-small-output laser beam, it has a problem that a base film is softened and fused because the light-heat conversion layer produces heat and the temperature suddenly rises for a type of printer in which a large-output laser beam is converged and applied to an object.

To solve the above problem, a method is invented for preventing the base film from fusing by increasing the film thickness. However, this method cannot practically be used because it causes the cost and the housing space in the printer to increase.

The present invention is made to solve the above problem and its object is to provide a transfer recording medium for obtaining satisfactory transfer images without fusing a base film even if the medium is used for a type of printer in which a large-output laser beam is converged and applied to an object.

SUMMARY OF THE INVENTION

It is possible to solve the above-mentioned problems by the present invention wherein at least one layer preventing heat produced by the light-heat conversion agent from being absorbed by the base film is further formed on the base film. Particularly, the present invention relates to a transfer recording medium characterized in that said layer is formed between a base film and a light-heat conversion layer or an ink layer containing a light-heat conversion agent and sublimating dye as an adiabatic layer or a heat absorbing layer, or that a heat absorbing layer which is said layer preventing heat from being absorbed by the base film is formed on another side of the base film opposite to the surface where the light-heat conversion layer and the ink layer are formed.

DETAILED DESCRIPTION OF THE PREFERRED EMBODIMENTS

Figure 1:
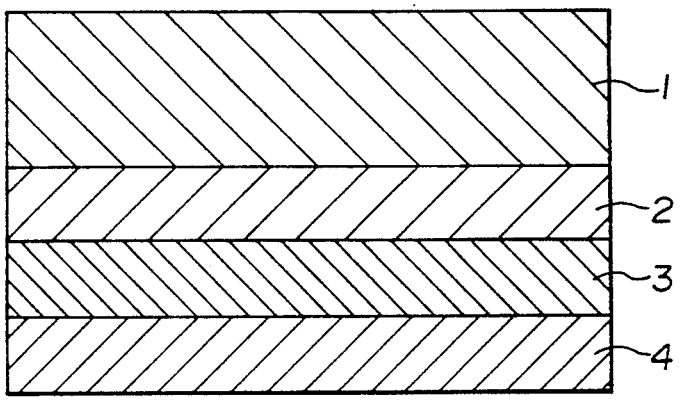
FIG. 1 is a sectional view of the first and the second embodiments of the transfer recording medium of the present invention.

The transfer recording medium of the present invention is described in detail below by referring to the drawings.

FIG. 1 is a sectional view of the first and the second embodiments of the transfer recording medium of the present invention, in which layer (2), light-heat conversion layer (3) containing a light-heat conversion agent, and ink layer (4) containing a sublimating dye are coated in order on one side of a base film (1). In the first embodiment the layer (2) exhibits an adiabatic layer and in the second embodiment the layer (2) exhibits a heat absorbing layer.

For the base film (1), it is preferable to use a film having the thickness of 2 to 8 μm, being transparent, and made of polyester, polyamide, polysulfone, or aramid resin.

Because the adiabatic layer (2) is coated so that the heat produced by the light-heat conversion layer does not transfer to the base film, it is preferable to use a layer made of a transparent substance with the thermal conductivity of 0.2 kcal/mh °C. or less allowing a laser beam to transmit for the adiabatic layer (2).

Concretely, organic high molecular materials including polystyrene, polycarbonate, polypropylene, nylon, acrylic, epoxy, ethyl-cellulose, butadiene, and phenol resins, or inorganic materials including silicone resins, or copolymers of the above materials including styrene-butadiene and acrylic-silicon copolymers and the like can be used as the adiabatic layer (2).

To form a film, any of these materials is dissolved or dispersed in a solvent, applied to the surface of a base film with a printing machine or coater, and dried. It is also possible to form the film with the technique for evaporation.

The adiabatic layer generally uses a foamed resin because it has a small thermal conductivity. However, it is not preferable to use the foamed resin for the adiabatic layer of the present invention because it scatters a laser beam.

The heat absorbing layer (2) comprises one selected from the groups of plant wax, e.g. paraffin wax, carnauba wax, and synthetic hydrocarbon wax, e.g. polyethylene wax or mixture thereof. It is preferable to mix the above-mentioned compounds with ethylene-vinyl acetate copolymer when applying it. Preferable amount of said mixed copolymer is 5–30% by weight based on said wax. Preferable amount of vinyl acetate in said copolymer is 40–80%. Said layer is formed by dispersing a wax, e.g. paraffin wax in a solvent, e.g. water which can solve the wax and applying it.

The light-heat conversion layer (3) can use a material having an absorbing wavelength in the infrared zone with the wavelength of 700 nm or more and the light transmittance of 20% or less in the wavelength such as carbon black or black dye. The material is formed into a film by dissolving or dispersing the material in a solvent such as toluene or methyl ethyl ketone and applying it or mixing it with a binder resin such as polyester or urethane resin or vinyl chloride-vinyl acetate copolymer resin and applying it. It is also possible to form the material into a film with the technique for evaporation.

The ink layer (4) containing a sublimating dye is formed by mixing azo-, quinophthalone-, anthraquinone-, styryl-, or indoaniline-based sublimating dye with a binder resin such as cellulose, polyester, epoxy, polyvinyl-alcohol, or acrylic resins, dissolving or dispersing the mixture in a solvent, and applying it.

The ink layer thickness of 0.3 to 3.0 μm is preferable. For the layer thickness of 0.3 μm or less, no satisfactory image can be formed because the transfer density is too low. For the layer thickness of 3.0 μm or more, no necessary transfer density can be obtained because a dye is not completely sublimated only by the heat obtained from the light-heat conversion layer.

It is possible to use the ink layer (4) containing a sublimating dye as a mono-color transfer recording medium by applying the layer of one color to the base film or as a full-color transfer recording medium by applying each independent layer of three colors of yellow, Magenta, and cyanogen to the base film and also forming a black layer on the film.

Figure 2:
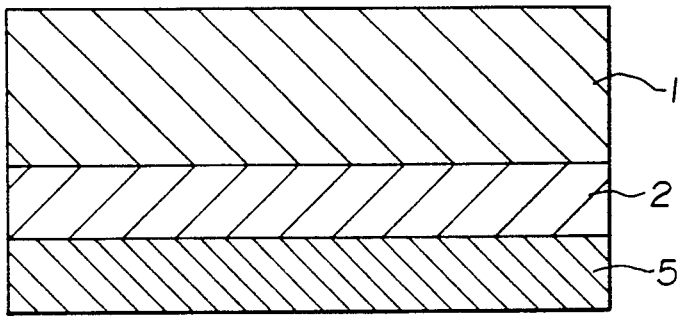
FIG. 2 is a sectional view of the third and the fourth embodiments of the transfer recording medium of the present invention.

FIG. 2 is a sectional view of the third and the fourth embodiments of the transfer recording medium of the present invention, in which layer (2) and an ink layer (5) containing both light-heat conversion agent and sublimating dye are laminated in order on one side of the base film (1). In the third embodiment the layer (2) exhibits an adiabatic layer and in the fourth embodiment the layer (2) exhibits a heat absorbing layer.

The ink layer (5) containing both light-heat conversion agent and sublimating dye is formed by mixing the material having an absorbing wavelength in the infrared zone with the wavelength of 700 nm or more and the light transmittance of 20% or less used for the light-heat conversion layer (3) with the sublimating dye and binder resin used for the ink layer (4). The film forming method is the same as the method for forming the ink layer (4) containing a sublimating dye. The layer thickness of 5.0 μm or less is preferable. The layer thickness of more than 5.0 μm is not preferable because the transfer density decreases since the light-heat conversion energy is almost consumed to increase the temperature of the ink layer (5), it is not completely transferred to the ink layer containing a sublimating dye, and the heat produced by the light-heat conversion agent is not enough to sublimate the dye.

When the ink layer (5) containing both light-heat conversion agent and sublimating dye is formed, satisfactory effects are obtained in view of the cost because the manufacturing process is simplified compared with the case in which the light-heat conversion layer (3) and the ink layer (4) containing a sublimating dye are separately formed.

The transfer recording medium of the present invention with the above constitution forms an image by press-fitting the medium with an object to be transferred on which a resin layer such as polyester or vinyl-chloride resin capable of accepting a dye is formed or making the medium face the object with an interval of several μm to several tens of μm and applying a laser beam to the surface opposite to the ink layer of the transfer recording medium to transfer the sublimating dye to the surface of the object.

In this case, the light-heat conversion agent in the light-heat conversion layer (3) or the ink layer (5) containing the light-heat conversion agent and sublimating dye receives the laser beam to produce heat, the dye is transferred to the surface of the object due to the produced heat, and the object is dyed. Though any general laser-beam generator can be used, it is preferable to use a semiconductor laser capable of generating large energy.

Figure 3:
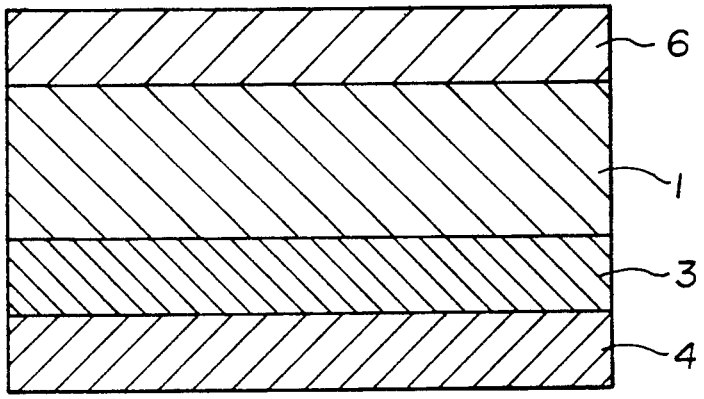
FIG. 3 is a sectional view of the fifth embodiment of the transfer recording medium of the present invention.

FIG. 3 is a sectional view of the fifth embodiment of the transfer recording medium of the present invention, in which a light-heat conversion layer (3) and an ink layer (4) containing a sublimating dye are laminated in order on one side of a base film (1) and a heat absorbing layer (6) is formed on the other side of the base film.

The heat absorbing layer (6) is formed similarly to the procedure for the second embodiment and the base film (1), light-heat conversion layer (3), and ink layer (4) containing a sublimating dye are formed similarly to the procedure for the first embodiment. Therefore, the description of the methods for forming these layers is omitted.

Figure 4:
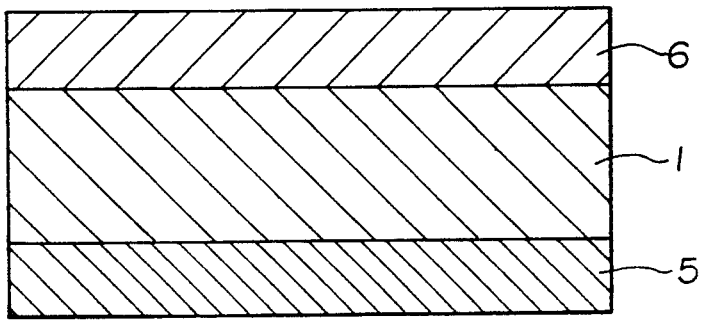
FIG. 4 is a sectional view of the sixth embodiment of the transfer recording medium of the present invention.

FIG. 4 is a sectional view of the sixth embodiment of the transfer recording medium of the present invention, in which an ink layer (5) containing a light-heat conversion agent and sublimating dye is formed on one side of a base film (1) and a heat absorbing layer (6) is formed on the other side of the base film. The ink layer (5) containing a light-heat conversion agent and sublimating dye is formed similarly to the procedure for the second example and the heat absorbing layer (6) is formed similarly to the procedure for the third example. Therefore, the description of the methods for forming these layers is omitted.

The heat produced by a light-heat conversion agent is hardly transferred to a base film because conduction of the heat is interrupted by an adiabatic layer. Therefore, the base film is not fused. Also, the heat produced by the light-heat conversion agent hardly remains in the base film because it is absorbed by a heat absorbing layer. Therefore, the base film is not fused.

EMBODIMENT 1

A sublimating-type transfer recording medium is obtained by using a PET film with the thickness of 5.7 μm as a base film, successively applying a composition made by mixing various substances below to the film, and drying it to form an adiabatic layer, light-heat conversion layer, and ink layer containing a sublimating dye. The total thickness of the dried adiabatic layer, light-heat conversion layer, and ink layer containing a sublimating dye is set to 4.0 μm. Composition for forming the adiabatic layer:

| Composition for forming the adiabatic layer: | |
|---|---|
| Styrene-butadiene copolymer SORUPUREN T-474 (Made by ASAHI CHEMICAL INDUSTRY CO., LTD.): | 20 wt % |
| Ethyl acetate: | 80 wt % |

The adiabatic layer with the dried layer thickness of 2.5 μm is formed by applying the above composition to the PET film with a wire bar coater.

| Composition of the light-heat conversion layer: | |
|---|---|
| Carbon black MHI Black (Made by MIKUNI SHIKISO Co., Ltd.): | 3 wt % |
| Polyester resin BAIRON 200 (Made by TOYOBO CO., LTD.): | 3 wt % |
| Toluene/methyl ethyl ketone = 1/1: | 94 wt % |

The light-heat conversion layer with the dried layer thickness of 0.5 μm is formed by applying the above composition to the adiabatic layer with a wire bar coater.

| Composition for the ink layer containing a sublimating dye; | |
|---|---|
| Cyanogen dye SERESU-BLUE GN (Made by Bayer Limited): | 5 wt % |
| Butyral resin ESUREC BX1 (Made by Sekisui Chemical Co., Ltd.): | 5 wt % |
| Toluene/methyl ethyl ketone = 1/1: | 90 wt % |

The ink layer containing a sublimating dye with the dried layer thickness of 1.0 μm is formed by applying the above composition to the light-heat conversion layer with a wire bar coater.

The obtained ink layer containing a sublimating dye of the transfer recording medium is put on a piece of image-receiving paper made of synthetic paper having a polyester resin image receiving layer on its surface with a gap of 50 μm to apply the semiconductor laser beam SLD 303XT made by SONY CORP. (with the beam diameter of 300 μm, the wavelength of 810 nm, and the maximum optical output of 500 mW) to the layer from the transfer recording medium side for 20 ms. As a result, a satisfactory transfer image is obtained without fusing the PET film which is a base material.

COMPARISON EXAMPLE 1

As the result of making a transfer recording medium same as the embodiment 1 except to exclude the adiabatic layer and transferring it to a piece of image receiving paper, the PET film which is the base material of the transfer recording medium is fused and no image is formed.

EMBODIMENT 2

A transfer recording medium is obtained similarly to the procedure for the embodiment 1 except to form an ink layer containing a light-heat conversion agent and sublimating dye instead of forming a light-heat conversion layer and an ink layer containing a sublimating dye by applying a composition made by mixing the following substances to the layer.

| Composition for the ink layer containing a light-heat conversion agent and sublimating dye | |
|---|---|
| Carbon black MHI Black (Made by MIKUNI SHIKISO Co. Ltd.): | 3 wt % |
| Cyanogen dye SERESU-BLUE GN (Made by Bayer Limited): | 5 wt % |
| Butyral resin ESUREC BX1 (Made by Sekisui Chemical Co., Ltd.): | 7 wt % |
| Toluene/methyl ethyl ketone = 1/1: | 85 wt % |

As the result of transferring the obtained transfer recording medium to a piece of image receiving paper with a laser beam similarly to the procedure for the embodiment 1, a satisfactory transfer image is obtained without fusing the PET film which is a base material.

EMBODIMENT 3

A transfer recording medium is obtained similarly to the procedure for the embodiment 1 except to form a heat absorbing layer consisting of a composition made by mixing the following substances on a base film at the opposite side to a light-heat conversion layer instead of forming an adiabatic layer.

| Composition for forming the heat absorbing layer | |
|---|---|
| Paraffin wax Hi-Mic2045 (Made by NIHON SEIRO Co., Ltd.): | 30 wt % |
| Water: | 70 wt % |

The heat absorbing layer with the dried layer thickness of 2.5 μm is formed by applying the above composition to the surface opposite to the surface of the PET film where the light-heat conversion layer and ink layer are formed with a wire bar coater.

As the result of transferring the obtained transfer recording medium to a piece of image receiving paper with a laser beam similarly to the procedure for the embodiment 1, a satisfactory transfer image is obtained without fusing the PET film which is a base material.

EMBODIMENT 4

A transfer recording medium is obtained similarly to the procedure for the embodiment 2 except to form a heat absorbing layer same as that of the embodiment 3 on the surface at the opposite side to the light-heat conversion layer of a base film instead of forming an adiabatic layer.

As the result of transferring the obtained transfer recording medium to a piece of image receiving paper with a laser beam similarly to the procedure for the embodiment 1, a satisfactory transfer image is obtained without fusing the PET film which is a base material.

EMBODIMENT 5

A transfer recording medium is obtained similarly to the procedure for the embodiment 1 except to form a heat absorbing layer same as that of the embodiment 3 instead of the adiabatic layer.

As the result of transferring the obtained transfer recording medium to a piece of image receiving paper with a laser beam similarly to the procedure for the embodiment 1, a satisfactory transfer image is obtained without fusing the PET film which is a base material.

EMBODIMENT 6

A transfer recording medium is obtained similarly to the procedure for the embodiment 2 except to form a heat absorbing layer same as that of the embodiment 3 instead of the adiabatic layer.

As the result of transferring the obtained transfer recording medium to a piece of image receiving paper with a laser beam similarly to the procedure for the embodiment 1, a satisfactory transfer image is obtained without fusing the PET film which is a base material.

ADVANTAGES OF THE INVENTION

Because the transfer recording medium of the present invention has the above constitution, the following advantages are obtained.

(1) A satisfactory transfer object is obtained without fusing a base film even if the medium is used for a type of printer in which a large-output laser beam is converged and applied.

(2) A high transfer density is obtained because the heat lost to fuse the base film is used to heat a sublimating dye.

What is claimed is:

1. A transfer recording medium in which at least one light-heat conversion layer containing a light-heat conversion agent and one ink layer containing a sublimating dye are coated in order on one side of a base film, or at least one ink layer containing both light-heat conversion agent and sublimating dye is coated on one side of a base film, characterized in that at least one layer preventing heat produced by the light-heat conversion agent from being absorbed by the base film is further formed on the base film.

2. A transfer recording medium according to claim 1, wherein the layer preventing heat from being absorbed by the base film is formed between the light-heat conversion layer and the base film as an adiabatic layer.

3. A transfer recording medium according to claim 2, wherein said adiabatic layer is made of a transparent resin or inorganic material with the thermal conductivity of 0.2 kcal/mh °C. or less.

4. A transfer recording medium according to claim 2, wherein said adiabatic layer is made of one selected from the group consisting of polystyrene, polycarbonate, polypropylene, nylon, acrylic, epoxy, ethyl-cellulose, butadiene, and phenol resins, or inorganic materials, or copolymers of the above materials or mixture thereof.

5. A transfer recording medium according to claim 4, wherein the inorganic materials are silicone resins.

6. A transfer recording medium according to claim 1, wherein the layer preventing heat from being absorbed by the base film is formed between the light-heat conversion layer and the base film as a heat absorbing layer.

7. A transfer recording medium according to claim 1, wherein the layer preventing heat from being absorbed by the base film is formed on the side of the base film opposite to the side wherein the light-heat conversion layer and the ink layer are formed.

8. A transfer recording medium according to any one of claims 6 or 7, wherein said heat absorbing layer comprises one selected from the group of plant wax and synthetic hydrocarbon wax or mixture thereof.

9. A transfer recording medium according to any one of claims 6 or 7, wherein said heat absorbing layer comprises one selected from the group of paraffin wax, carnauba wax and polyethylene wax.

* * * * *